US007247133B2

(12) United States Patent
Gronnegaard et al.

(10) Patent No.: US 7,247,133 B2
(45) Date of Patent: Jul. 24, 2007

(54) DECANTER CENTRIFUGE WITH WEAR REINFORCEMENT INLET

(75) Inventors: Erland Gronnegaard, Rodovre (DK); Jacob Hyldegaard, Frederiksberg (DK)

(73) Assignee: Alfa Laval Copenhagen A/S, Soborg (DK)

( * ) Notice: Subject to any disclaimer, the term of this patent is extended or adjusted under 35 U.S.C. 154(b) by 112 days.

(21) Appl. No.: 10/507,104

(22) PCT Filed: Mar. 14, 2003

(86) PCT No.: PCT/DK03/00168

§ 371 (c)(1),
(2), (4) Date: Aug. 12, 2005

(87) PCT Pub. No.: WO03/076078

PCT Pub. Date: Sep. 18, 2003

(65) Prior Publication Data

US 2006/0025297 A1 Feb. 2, 2006

(30) Foreign Application Priority Data

Mar. 14, 2002 (DK) ..... 2002 00398

(51) Int. Cl.
*B04B 1/20* (2006.01)

(52) U.S. Cl. ..... 494/53

(58) Field of Classification Search ..... 494/50–55; 210/380.1, 380.3

See application file for complete search history.

(56) References Cited

U.S. PATENT DOCUMENTS 3,148,145 A * 9/1964 Reed ..... 494/53
3,428,246 A 2/1969 Finkelston
3,568,919 A * 3/1971 Nielsen ..... 494/53
3,568,920 A * 3/1971 Nielsen ..... 494/53
4,142,669 A * 3/1979 Burlet ..... 494/53
5,244,584 A * 9/1993 Schlieperskoetter ..... 210/787
5,259,828 A * 11/1993 Schlieperskoetter ..... 494/38

(Continued)

FOREIGN PATENT DOCUMENTS

DE 1815199 A 7/1969

(Continued)

*Primary Examiner*—Charles E. Cooley
(74) *Attorney, Agent, or Firm*—Browdy and Neimark, PLLC

(57) ABSTRACT

A decanter centrifuge has a hollow, rotatable drum with a screw conveyor comprising a core body (1), in which an inlet opening for material into the drum from an inlet chamber (3) is provided, the inlet opening having a delimitation surface (7) which is rear relative to the direction of rotation and extending substantially axially, said delimitation surface being provided with a wear reinforcement member (8). The wear reinforcement member extends along the rear delimitation surface (7) into the inlet chamber (3). The wear reinforcement member (8) is provided with abutment surfaces (11; 19) in abutment against abutment surfaces associated with the core body, which during operation prevents the wear reinforcement member (8) from moving tangentially forwards in the in the direction of rotation and radially out of the core body (1). At least one of said abutment surfaces associated with the core body (1) is constituted by a removable blocking member (17). The wear reinforcement member (8) and the inlet opening (5) are designed in such a manner that the wear reinforcement member (8) can be introduced to its operating position from the exterior side of the core body (1)

12 Claims, 5 Drawing Sheets

U.S. PATENT DOCUMENTS

Figure 1:
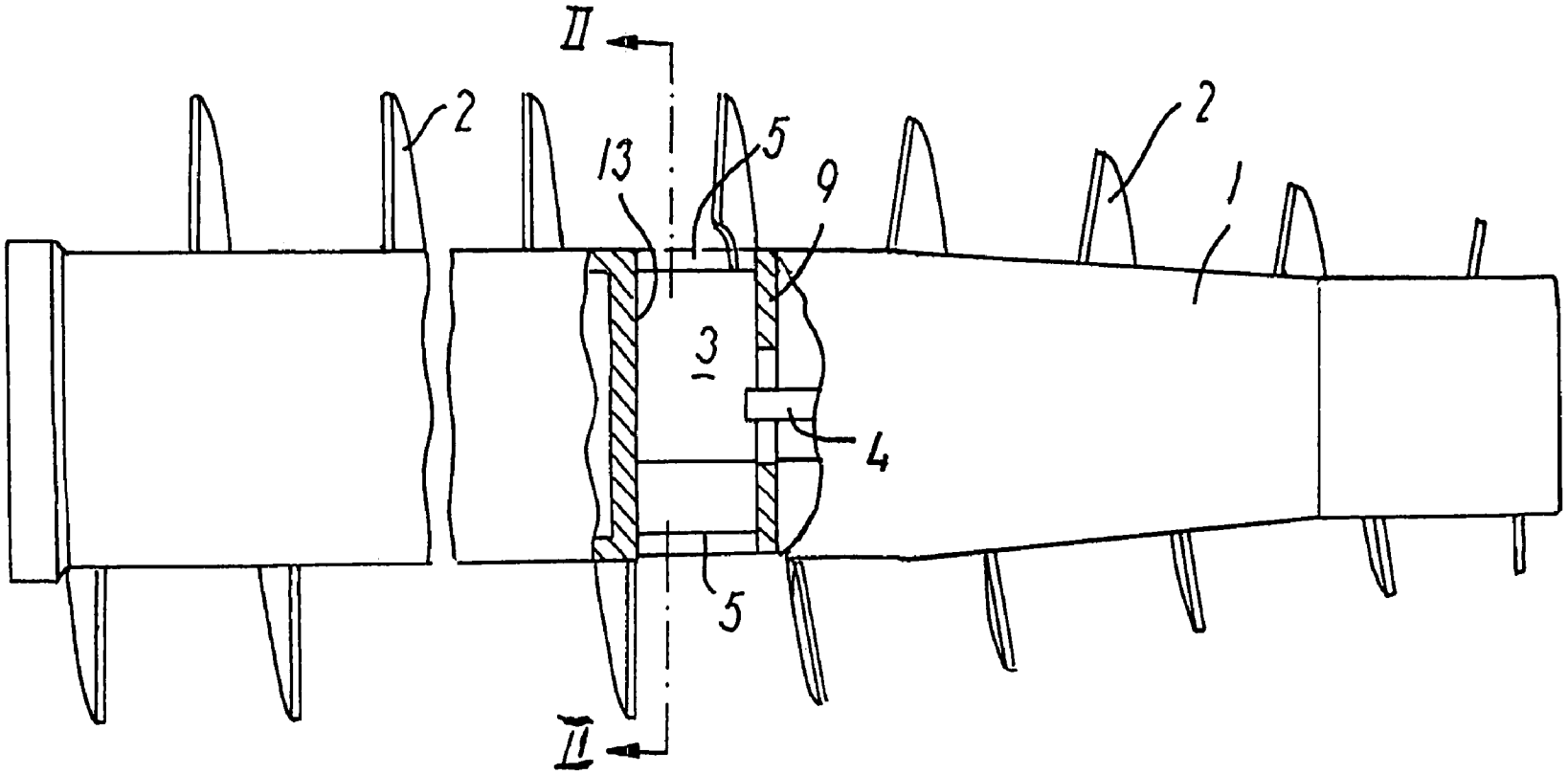

| | | | | |
|---|---|---|---|---|
| 5,380,434 | A * | 1/1995 | Paschedag | 210/360.2 |
| 5,401,423 | A * | 3/1995 | Leung et al. | 210/787 |
| 7,060,019 | B2 * | 6/2006 | Hermeler et al. | 494/53 |
| 2006/0025297 | A1 * | 2/2006 | Gronnegaard et al. | 494/53 |
| 2006/0166803 | A1 * | 7/2006 | Schulz et al. | 494/56 |
| 2006/0240966 | A1 * | 10/2006 | Lantz | 494/54 |

FOREIGN PATENT DOCUMENTS

| | | | | |
|---|---|---|---|---|
| DE | 3723864 | A1 | | 1/1989 |
| DE | 4041868 | A1 | | 2/1992 |
| DE | 4041868 | A1 | * | 7/1992 |
| JP | 11267549 | A | * | 10/1999 |
| WO | WO 3076078 | A1 | * | 9/2003 |

* cited by examiner

DECANTER CENTRIFUGE WITH WEAR REINFORCEMENT INLET

The present invention relates to a decanter centrifuge with a hollow drum having a longitudinal axis of rotation and a direction of rotation, a screw conveyor in the drum comprising a core body carrying at least one helical winding, wherein an inlet chamber is provided in the core body, said inlet chamber having an inlet opening for inlet of material into the drum from the inlet chamber, a central inlet being provided in the inlet chamber as well as an end wall in the inlet chamber opposite the central inlet, the inlet opening having a delimitation surface, which is rear relative to the direction of rotation and extending substantially axially, said delimitation surface being provided with a wear reinforcement, and a preferably substantially tangentially extending edge, which is distal relative to the central inlet.

The rear delimitation surface may be rounded in such a manner that its foremost point is positioned radially within the envelope surface of the surface of the core body, Preferably, two or more inlet openings are provided.

The invention further relates to a wear reinforcement member for such a decanter centrifuge.

DE-A-40 41 868 discloses a centrifuge with a core body assembled from several parts bolted together, which makes it possible to disassemble them and give access to the interior of the inlet chamber. The inlets from the inlet chamber into the drum are lined with wear bushings, which have a collar such that they are secured against the centrifugal force, but have to be replaced from the inside.

It is furthermore known to use wear reinforcement members, which are welded onto the core body. It is very work demanding to exchange such wear reinforcement members, and weldable materials are generally not very wear-resistant, for which reason such wear reinforcement members have to be replaced often.

The object of the invention is to provide a decanter centrifuge having a wear reinforcement member, which is easy to exchange and which only lays down a few restrictions for the choice of material.

This object is according to the invention met in that the wear reinforcement comprises a wear reinforcement member extending along the rear delimitation surface and, when viewed in section transverse to the direction of the axis of rotation, extending around the rear delimitation surface, the wear reinforcement member extending so far into the inlet chamber along its wall that a concave back surface of the wear reinforcement member facing the rear delimitation surface has an interior portion in the inlet chamber, said portion being positioned behind the foremost point of the rear delimitation surface viewed relative to the direction of rotation, that the wear reinforcement member is provided with an abutment surface with a component facing tangentially opposite the back surface in abutment against an abutment surface associated with the core body and which during operation prevents the wear reinforcement member from moving tangentially forwards in the direction of rotation, and an abutment surface with a radially outwards facing component in abutment against an abutment surface associated with the core body preventing the wear reinforcement member from moving radially out of the core body, that at least one of said abutment surfaces associated with the core body is constituted by a removable blocking member and that the wear reinforcement member and the inlet opening are designed in such a manner that the wear reinforcement member can be introduced to its operating position from the exterior side of the core body.

In this manner an easy replacement is obtained as it may take place from the outside, and no special demands are made to the securing of the wear reinforcement member, which is kept in place by the blocking member and other engaging surfaces.

In a preferred embodiment the wear reinforcement member comprises at least one end portion extending along an end wall of the inlet chamber, said end wall extending from the distal edge. In this manner this end wall is protected too.

With a view to its securing and to additional wear protection the wear reinforcement member comprises a second end portion at the opposite end relative to the first end portion, said second end portion extending along a proximal wall in the inlet chamber, the wear reinforcement member extending between the end wall and the proximal wall. Preferably, at least one end portion is accommodated in a recess in the adjacent wall. In this way substantially smooth end wall surfaces are obtained in the inlet chamber, and the abutment surface for preventing tangential movement may be constituted of an area in the recess or recesses, when said recesses are designed in correspondence with the end portions.

Preferably, a deeper recess accommodating the blocking member is provided in the wall at the end of said recess opposite said rear delimitation surface. The blocking member is preferably not tightened against the wear reinforcement member. In this manner it becomes possible to use a comparatively brittle material for the wear reinforcement member.

Preferably, a filling material for filling out irregularities is provided between the wear reinforcement member and the rear delimitation surface. Hereby, a well-defined supporting surface for the wear reinforcement member is ensured. The filling material may comprise epoxy or the like.

The wear reinforcement member is preferably made from a not weldable material, as a more wear-resistant material can be used without increase of the costs. In particular, the wear reinforcement member may comprise tungsten carbide, which is precisely a comparatively brittle, but very wear-resistant material and not weldable. However, the invention is not confined to the use of any definite material, and other materials suited for wear reinforcement may be used.

In a preferred embodiment the helical winding extends across an-inlet into the drum and a recess is provided in the helical winding at the inlet to allow replacement of the wear reinforcement member. Such an embodiment is in particular of interest, when the inlet has a wider axial extension than more than half of the pitch of the helical winding, which is often desirable to prevent the inlet from the inlet chamber to the drum from delimiting the total inlet capacity.

The object is further met by a wear reinforcement member for a decanter centrifuge, said member having the shape of a saddle.

The invention will now be described in detail in the following by means of an example of an embodiment with reference to the schematic drawings, in which FIG. 1 illustrates a screw conveyor of a decanter centrifuge with certain parts cut away, FIG. 2 a sectional view along the line II—II in FIG. 1, FIG. 3 a view corresponding to a part of FIG. 2, but of an embodiment of the invention, FIG. 4 a partially perspective view of the embodiment according to FIG. 3 with parts cut away to show a blocking member, and FIG. 5 a second partially perspective view of the embodiment according to FIG. 3.

Figure 2:
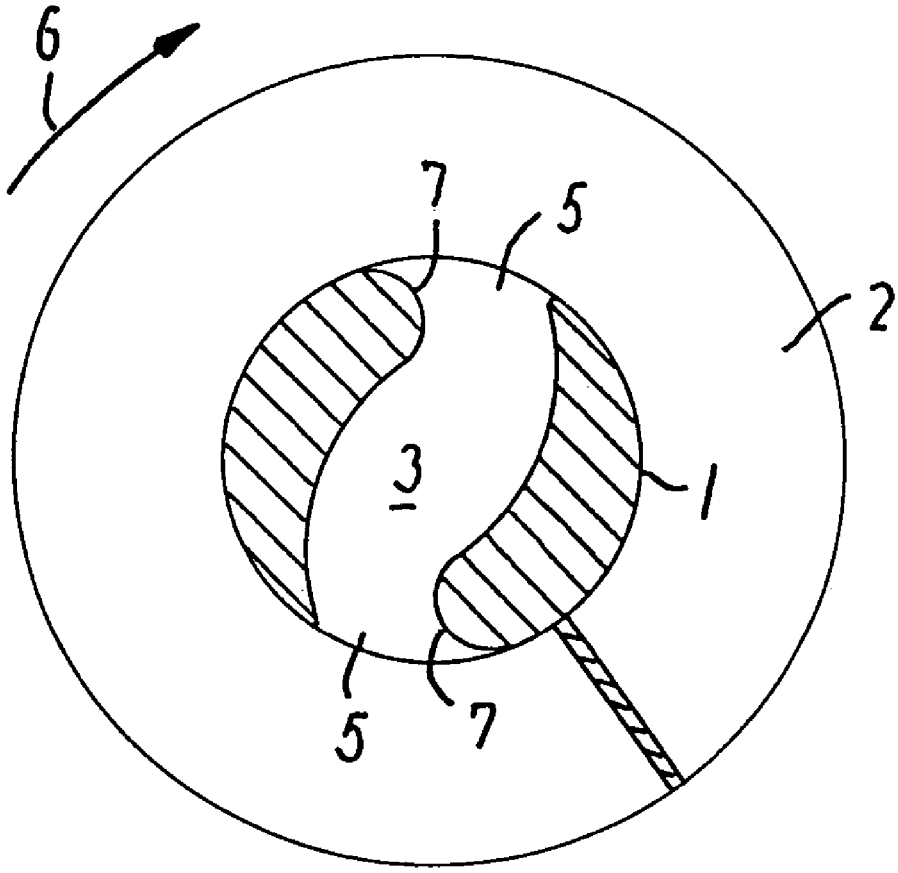

FIGS. 1 and 2 show a screw conveyor known per se of a decanter centrifuge. The screw conveyor comprises a core body 1 carrying a helical winding 2. For the sake of clarity, the helical winding has in FIG. 1 been cut away on the side facing the viewer.

An inlet chamber 3 is provided in the core body 1, into which chamber a central inlet tube 4 extends, and inlet openings 5 are provided, through which material to be centrifuged may flow from the inlet chamber 3 into a drum (not shown) surrounding the screw conveyor.

During operation the screw conveyor will together with the drum rotate as indicated by an arrow 6 in FIG. 2.

During operation material to be centrifuged will flow through the inlet tube 4 into the inlet chamber 3 and out through the inlet openings 5, the material flowing on account of the rotation across the rear, when seen in the direction of rotation, delimitation surfaces 7 of the inlet openings, which in the embodiment are rounded. The material flowing in is accelerated by the delimitation surfaces 7, which results in a considerable wear of these surfaces 7, which it is consequently desirable to protect.

Figure 3:
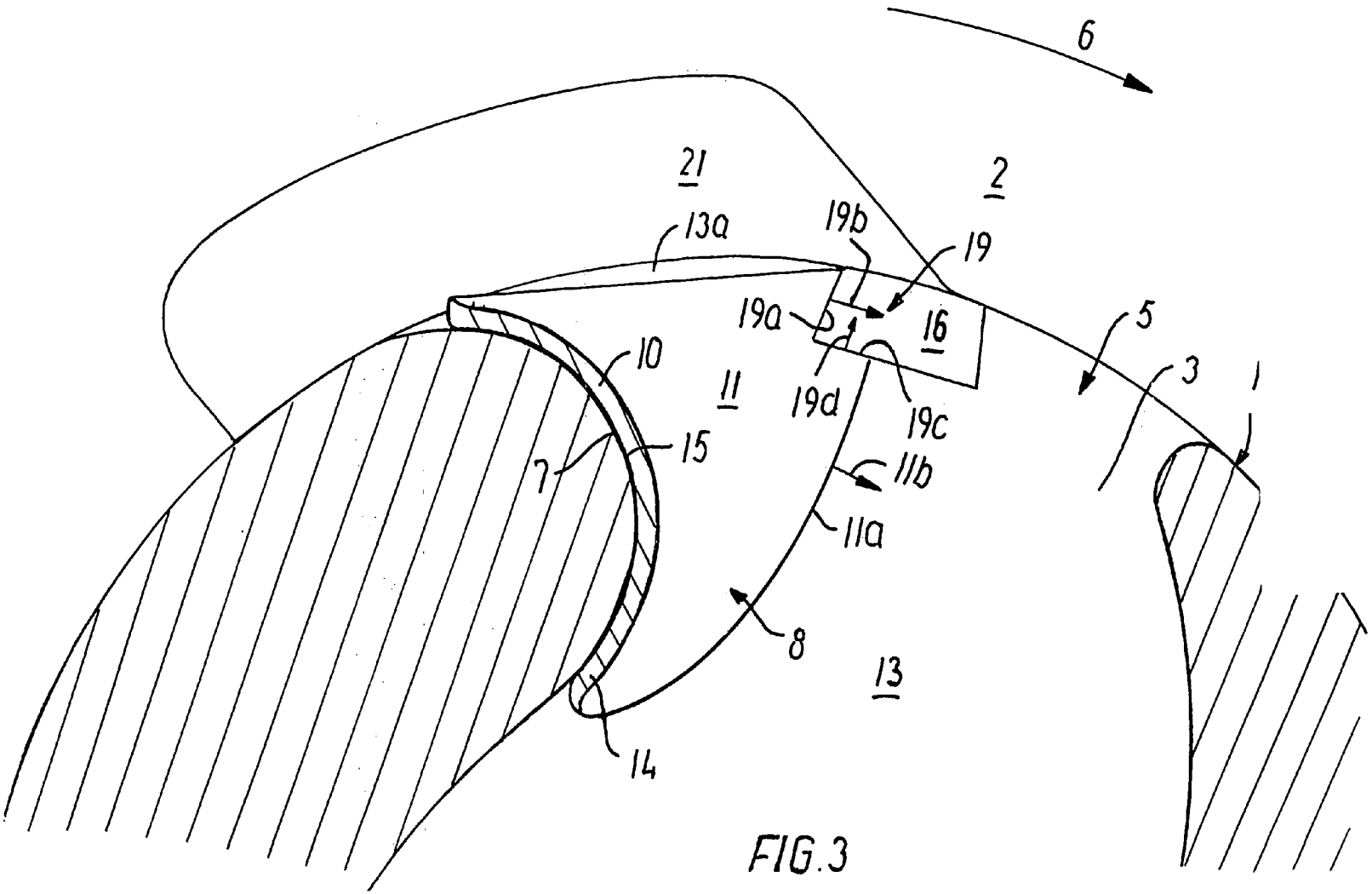
Figure 4:
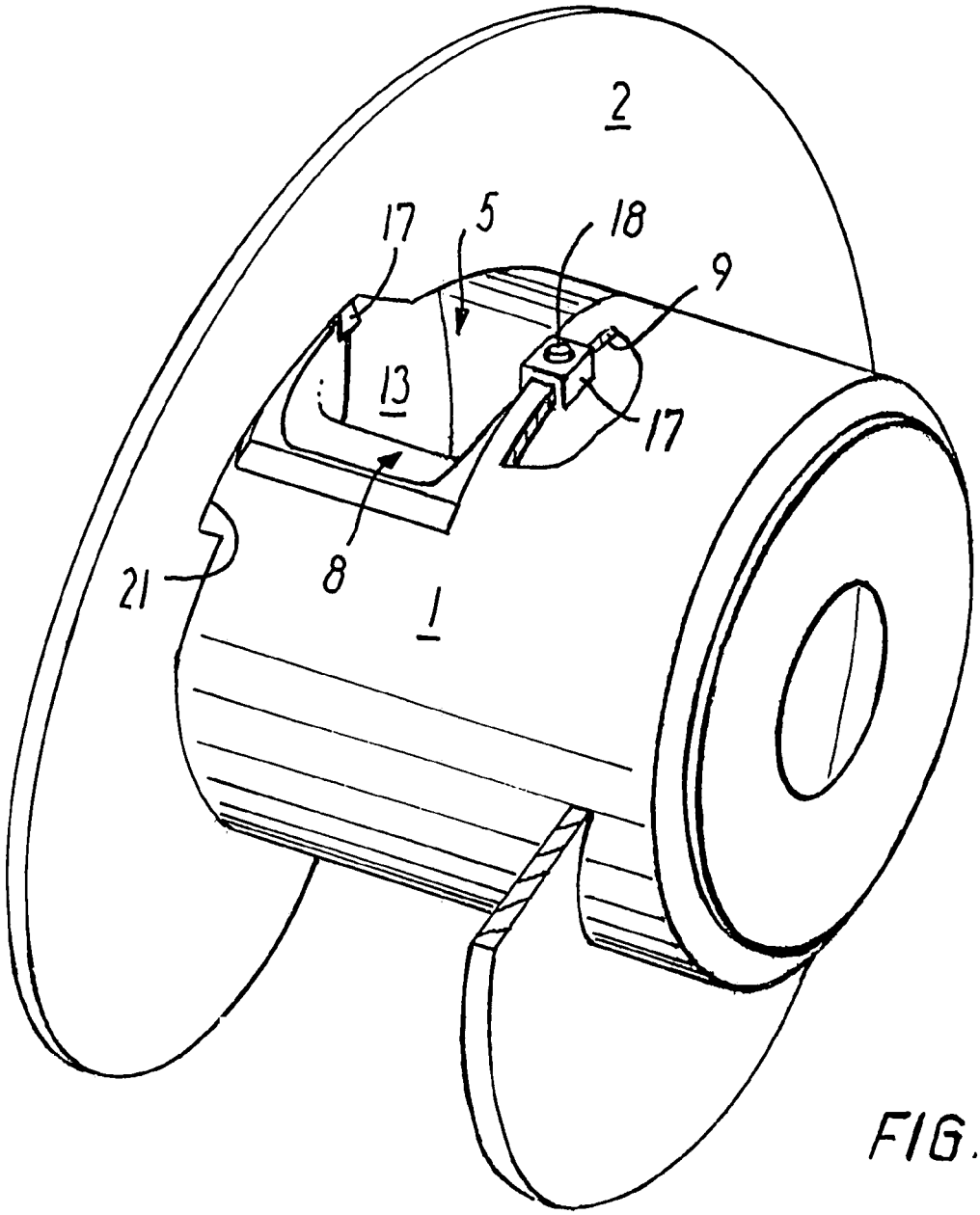
Figure 5:
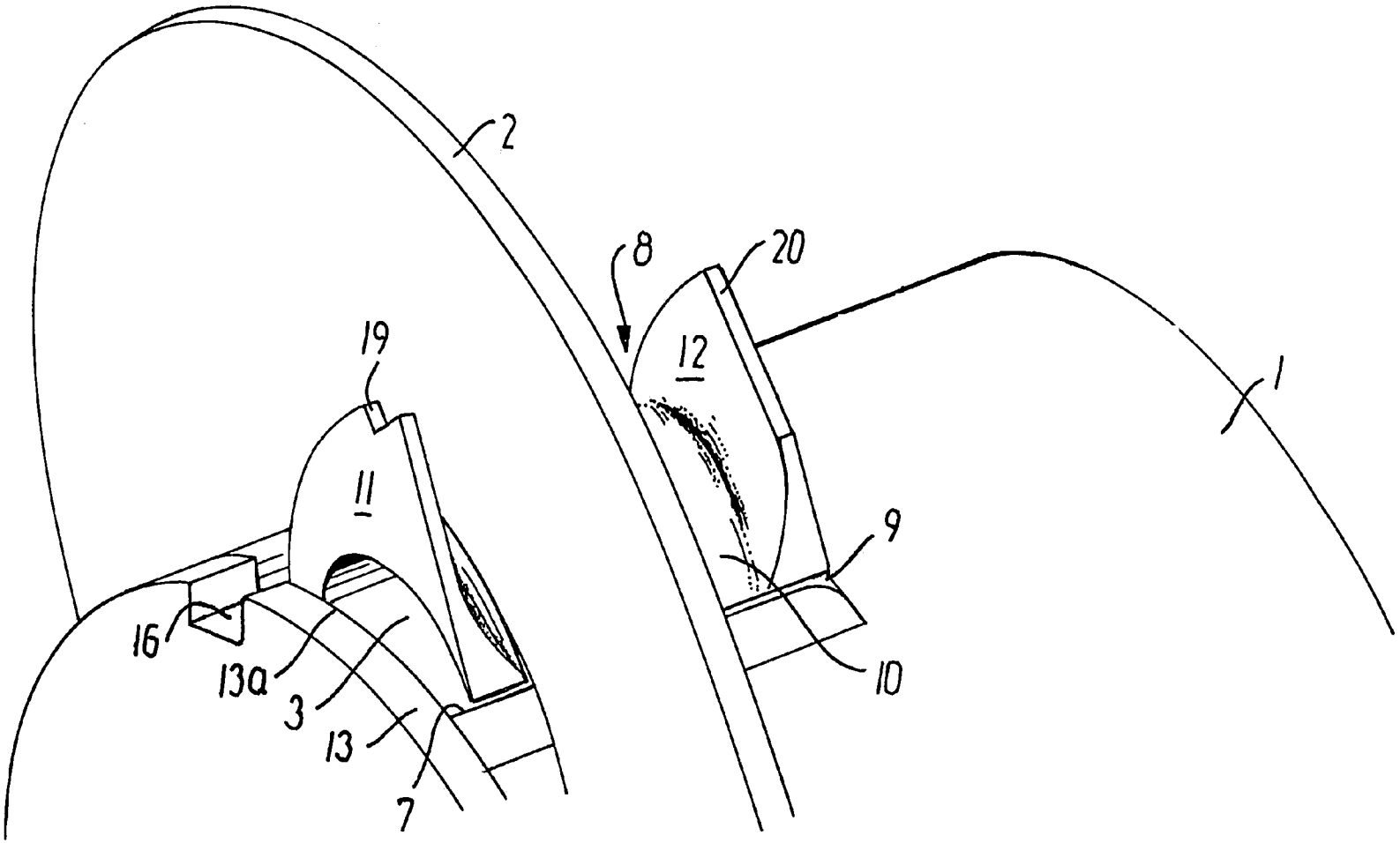

FIGS. 3–5 show in greater detail the area around an inlet opening 5, where the delimitation surface 7 is provided with a wear reinforcement member 8 according to the present invention. The inlet chamber 3 is defined at one end by proximal wall 9 provided with a central hole. At the other end the inlet chamber 3 is defined by an end wall 13.

The wear reinforcement member 8 generally has the shape of a saddle, the member comprising a cylinder-shaped body part 10 with end portions or flanges 11, 12 at the ends.

In the example, the wear reinforcement member 8 is made from tungsten carbide. It is not weldable, but is kept in place by its geometric design and its consequent engagement with the delimitation surface 7 and other surfaces, as will be explained in detail in the following.

The end wall 13 is defined by a distal edge 13*a* in the inlet opening 5. In the end wall 13 and in the proximal wall 9 recesses are provided for accommodating the flanges 11 and 12, such that the sides of these flanges facing one another substantially are in alignment with or slightly lowered relative to the adjacent surfaces of the end wall 13 and the proximal wall 9, respectively. In this manner is ensured that no edges protrude into the flow of material to be centrifuged.

A dovetail-shaped, axial groove 16 is provided in the end wall 13 and in the proximal wall 9 for accommodating a blocking member 17 to prevent the wear reinforcement member 8 from falling out. The blocking member 17 is kept in place by a screw 18 in the respective wall. The blocking members 17 are not tightened against the wear reinforcement member 8.

A recess 19 is provided in the flange 11 for accommodating the blocking member 17. The recess has a first abutment surface 19*a* with a tangentially facing component 19*b* and a second abutment surface 19*c* with a radially outwards facing component 19*d*.

Moreover, the flange 11 has a curved abutment surface 11*a* with a tangentially directed component 11*b*.

The flange 12 has a chamfered abutment surface 20, which in the operating position extends under the blocking member and which extends in the same plane as the abutment surface 19*c*.

The wear reinforcement member 8 extends so far into the inlet chamber 3 along its wall that an interior portion 14 of the back wall of the wear reinforcement member 8 facing the delimitation surface 7 is situated behind the foremost point 15 of the delimitation surface 7 seen relative to the direction of rotation 6.

The wear reinforcement member 8 is accommodated between the end wall 13 and the proximal wall 9, whereby it is kept in place in axial direction.

In tangential direction the wear reinforcement member 8 is kept in place by its abutment against the delimitation surface 2 and the abutment of the abutment surfaces 11 and/or 19*a* against wall in the recess in the end wall 13 (and correspondingly in the proximal wall 9) and against the blocking member 17, respectively. It should be noted that only one of the abutment surfaces 11*a* and 19*a* need to be present to attain the tangential securing of the wear reinforcement member 8.

In radial direction the wear reinforcement member 8 is kept in place against the centrifugal force by the engagement of the interior portion 14 with the delimitation surface 7 and the abutment of the abutment surfaces 19*c* and 20 against the blocking members 17.

In the direction towards the centre of the core body 1 the securing is less important, as the centrifugal force acts outwardly. However, it should be noted that the wear reinforcement member is prevented from falling into the inlet chamber 3 by its engagement with the exterior part of the delimitation surface 7; the engagement of the abutment surface 11*a* with the recess in the end wall 13 and/or the engagement of the on account of the dovetail-shape tilted abutment surface 19*a* with the blocking member 17.

Between the delimitation surface 7 and the body part 10 of the wear reinforcement member 8 a material has preferably been introduced for filling out the cavities, which might otherwise be present on account of the production tolerances. This material may for instance be epoxy or silicone. In this manner a well defined supporting surface for the wear reinforcement member is obtained.

A part of the helical winding 2 extends across the inlet 5, and in this part a recess 21 is provided. On account of this recess and the design of the wear reinforcement member 8 for that matter, it becomes possible to replace the wear reinforcement member from the exterior side of the core body 1, when this has been removed from the drum: The screws 18 are removed, the blocking members 17 are then pulled out axially from the dovetail-shaped groove 16, following which the wear reinforcement member 8 may be raised as indicated in FIG. 5. Then the wear reinforcement member 8 may be turned to be released from the helical winding 2 and a new wear reinforcement member 8 may be introduced by following the same operations in reverse order.

The invention claimed is:

1. A decanter centrifuge with a hollow drum having a longitudinal axis of rotation and a direction of rotation (6), a screw conveyor in the drum comprising a core body (1) carrying at least one helical winding (2), wherein an inlet chamber (3) is provided in the core body (1), said inlet chamber having an inlet opening (5) for inlet of material into the drum from the inlet chamber (3), a central inlet (4) being provided in the inlet chamber (3) as well as an end wall (13) in the inlet chamber (3) opposite the central inlet (4), the inlet opening (5) having a delimitation surface (7), which is rear relative to the direction of rotation and extending substantially axially, said delimitation surface being provided with a wear reinforcement (8), and a preferably substantially tangentially extending edge (13*a*), which is distal relative to the central inlet (4), characterized in that the wear reinforcement comprises a wear reinforcement member (8) extending along the rear delimitation surface (7) and, when viewed in section transverse to the direction of the axis of rotation (6), extending around the rear delimitation surface (7), the wear reinforcement member (8) extending so far into the inlet chamber (3) along its wall that a concave back surface of the wear reinforcement member (8) facing the rear delimitation surface (7) has an interior portion (14) in the inlet chamber, said portion being positioned behind the foremost point (15) of the rear delimitation surface (7) viewed relative to the direction of rotation (6), that the wear reinforcement member (8) is provided with an abutment surface (11*a;* 19*a*) with a component (11*b;* 19*b*) facing tangentially opposite the back surface in abutment against an abutment surface associated with the core body (1) and which during operation prevents the wear reinforcement member (8) from moving tangentially forwards in the direction of rotation (6), and an abutment surface (19*c*) with a radially outwards facing component (19*d*) in abutment against an abutment surface associated with the core body (1) preventing the wear reinforcement member (8) from moving radially out of the core body (1), that at least one of said abutment surfaces associated with the core body (1) is constituted by a removable blocking member (17) and that the wear reinforcement member (8) and the inlet opening (5) are designed in such a manner that the wear reinforcement member (8) can be introduced to its operating position from the exterior side of the core body (1).

2. A decanter centrifuge according to claim 1, characterized in that the blocking member (17) protrudes from the end wall (13) beyond a part of the wear reinforcement member (8).

3. A decanter centrifuge according to claim 1, characterized in that the wear reinforcement member (8) comprises at least one end portion (11) extending along an end wall (13) of the inlet chamber (3), said end wall extending from the distal edge (13*a*).

4. A decanter centrifuge according to claim 3, characterized in that the wear reinforcement member (8) comprises a second end portion (12) at the opposite end relative to the first end portion (11), said second end portion (12) extending along a proximal wall (9) in the inlet chamber (3), the wear reinforcement member (8) extending between the end wall (13) and the proximal wall (9).

5. A decanter centrifuge according to claim 3, characterized in that at least one end portion (11, 12) is accommodated in a recess in the adjacent wall (13, 9).

6. A decanter centrifuge according to claim 5, characterized in that in the wall (9, 13) at the end of said recess opposite said rear delimitation surface (7) a deeper recess (16) accommodating the blocking member (17) is provided.

7. A decanter centrifuge according to claims 1, characterized in that between the wear reinforcement member (9) and the rear delimitation surface (7) a filling material for filling out irregularities is provided.

8. A decanter centrifuge according to claim 7, characterized in that the filling material comprises epoxy.

9. A decanter centrifuge according to claim 1, characterized in that the wear reinforcement member (8) is made from a not weldable material.

10. A decanter centrifuge according to claim 9, characterized in that the wear reinforcement member (8) comprises tungsten carbide.

11. A decanter centrifuge according to claims 1, characterized in that the helical winding (2) extends across an inlet (5) into the drum and that a recess (21) is provided in the helical winding (2) at the inlet (5) to allow replacement of the wear member (8).

12. A wear member for a decanter centrifuge according to claims 1, characterized in having the shape of a saddle.

* * * * *